US007513505B2

(12) United States Patent
Berman et al.

(10) Patent No.: US 7,513,505 B2
(45) Date of Patent: Apr. 7, 2009

(54) SYSTEM AND METHOD FOR IDENTIFYING PAYOUTS IN GAMING SYSTEMS

(75) Inventors: Bradley Berman, Minnetonka, MN (US); Chad Shapiro, Plymouth, MN (US); Jason Malkovich, Chaska, MN (US)

(73) Assignee: King Show Games, Inc., Minnetonka, MN (US)

( * ) Notice: Subject to any disclaimer, the term of this patent is extended or adjusted under 35 U.S.C. 154(b) by 829 days.

(21) Appl. No.: 10/985,332

(22) Filed: Nov. 9, 2004

(65) Prior Publication Data

US 2005/0119041 A1 Jun. 2, 2005

Related U.S. Application Data

(60) Provisional application No. 60/519,071, filed on Nov. 9, 2003.

(51) Int. Cl.
*A63F 9/00* (2006.01)

(52) U.S. Cl. ..... 273/447; 273/448; 273/355; 463/7

(58) Field of Classification Search ..... 463/7, 463/17; 273/447, 448
See application file for complete search history.

(56) References Cited

U.S. PATENT DOCUMENTS 5,397,134 A * 3/1995 Fishman et al. ..... 463/25
5,855,374 A * 1/1999 Shoemaker, Jr. ..... 273/447
5,967,892 A * 10/1999 Shoemaker, Jr. ..... 463/7
6,139,429 A * 10/2000 Shoemaker, Jr. ..... 463/7
6,283,475 B1 * 9/2001 Stubben ..... 273/448
6,315,157 B1 * 11/2001 Halliburton ..... 221/87
6,338,678 B1 * 1/2002 Seelig et al. ..... 463/17
6,695,698 B1 * 2/2004 Anghelo et al. ..... 463/25
7,168,706 B2 * 1/2007 Pierce et al. ..... 273/448
7,258,610 B2 * 8/2007 Seelig et al. ..... 463/20
2004/0018865 A1 * 1/2004 Gilmore et al. ..... 463/7
2004/0048659 A1 * 3/2004 Seelig et al. ..... 463/25

* cited by examiner

*Primary Examiner*—Corbett Coburn
*Assistant Examiner*—Joshua P. Wert
(74) *Attorney, Agent, or Firm*—Hollingsworth & Funk, LLC

(57) ABSTRACT

A manner for presenting payouts in gaming activities. The invention may be used in connection with primary gaming activity and/or in connection with secondary/bonus activity. The invention provides a controllable selection and/or item capture mechanism used to identify full or partial payout values, and/or other play parameters such as multipliers, continue/discontinue identifiers, etc. The system and/or the user can control the selection/capture mechanism. In one embodiment, a platform typically concealed from the participant is moved to a location proximate the item capture mechanism, and a particular selectable item determined by the RNG is retrieved by the item capture mechanism among the otherwise perceivable selectable items.

22 Claims, 13 Drawing Sheets

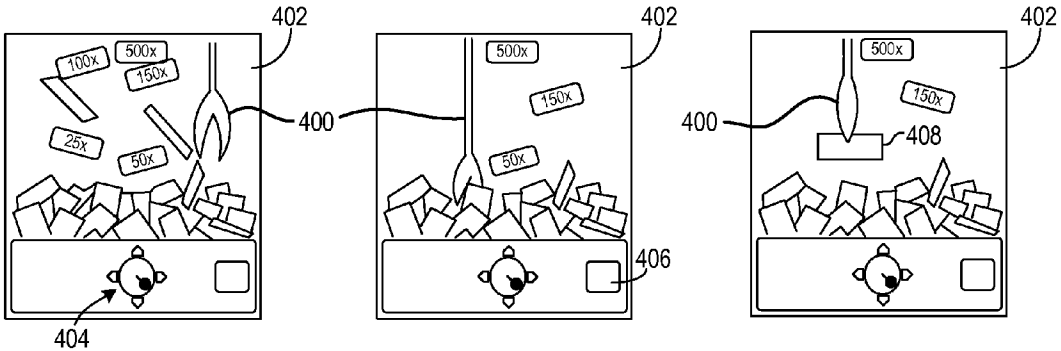
FIG. 4A
FIG. 4B
FIG. 4C
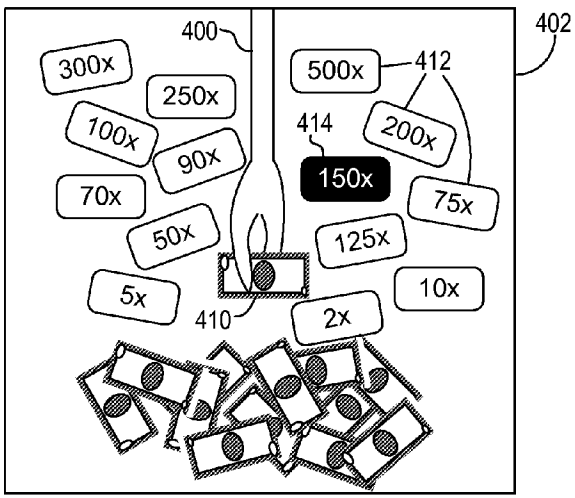
FIG. 4D

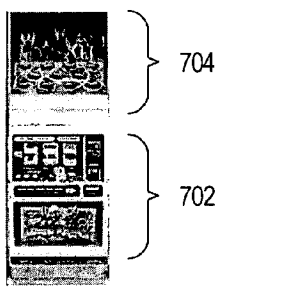
FIG. 7A
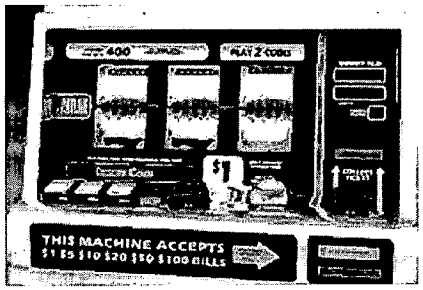
FIG. 7B
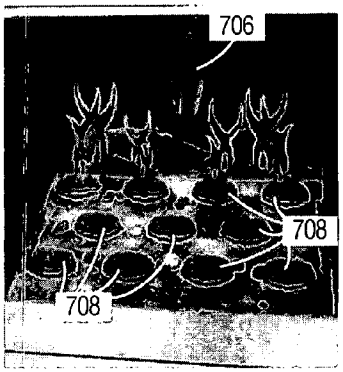
FIG. 7C
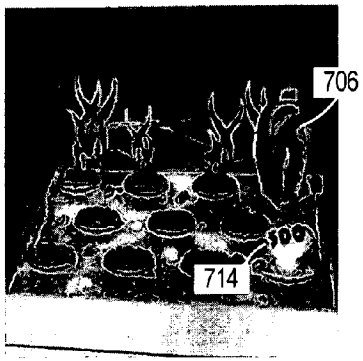
FIG. 7D
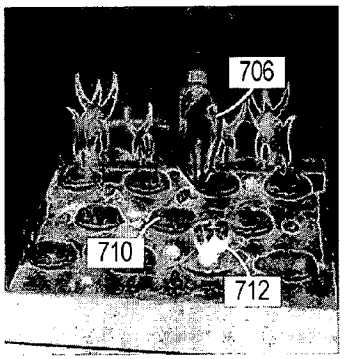
FIG. 7E
FIG. 7F

SYSTEM AND METHOD FOR IDENTIFYING PAYOUTS IN GAMING SYSTEMS

RELATED APPLICATIONS

This application claims the benefit of Provisional Application No. 60/519,071, filed on Nov. 9, 2003, to which priority is claimed pursuant to 35 U.S.C. §119(e), and which is hereby incorporated herein by reference in its entirety.

FIELD OF THE INVENTION

This invention relates in general to gaming, and more particularly to a system and method for identifying or otherwise presenting payouts in gaming systems.

BACKGROUND OF THE INVENTION

Gaming devices such as slot machines have been in use in the U.S. for over a century. The earliest slot machines originally paid out in cigars and chewing gum. Remnants of the early slot machines are manifested in the traditional "fruit" symbols such as cherries, lemons, oranges, etc., which represent the original flavors of gum. Notwithstanding the similarity of the symbols and reels associated with the slot machines of both today and yesteryear, modern day slot machine implementations are markedly different than their mechanical ancestors. This dramatic implementation disparity results primarily from the advent of computers and video capabilities.

Pure chance gaming devices such as slot machines have proved wildly popular, and in recent years have rivaled and even surpassed their once untouchable table game counterparts. One reason for this popularity is the increase in innovation, and the recognition of the need for human stimulation. While true that a primary motivator for people to play gaming devices is the chance to win monetary or other prizes (in the case of legalized gambling), the intrigue and excitement of playing these newly created machines lures people as well. It is therefore important in the gaming industry that gaming innovations be rolled out to the participating public.

Conventionally, participation in slot machines involves initiating the rotation of multiple reels, and allowing the machine to randomly stop the reel rotation such that associated reel symbols line up a payline. If the symbols on that payline correspond to a predetermined symbol combination, the participant wins an amount corresponding to the particular symbol combination. For multi-lined paylines, a coin or other token may be played for any one or more of the available paylines, and each of the paylines may provide a winning payout. When this occurs, the slot machine pays out according to the payoff table posted on the slot machine. The payoff table informs players of the winning symbol combinations for that machine, and what each combination pays based on the number of coins allocated for the spin. If a winning combination occurs, the machine releases money or tokens into a payout chute, or may award the winning amount onto a credit meter for the player. For example, if a player initially wagered three coins and that player won a high payout, that player may receive fifty coins of the same denomination in return, or may receive fifty credits for continued play.

It is a continual effort in the gaming industry to develop ways to attract and captivate players in playing gaming machines, such as slot games. One such manner of stimulating interest and heightening excitement has been through the use of "bonus" events. Bonus events or games are used to attract and keep players at a gaming machine. A bonus game is typically an additional gaming reel or machine, or a random selection device, that is enabled by a bonus qualifying signal from an underlying or primary gaming machine. Generally, a predetermined prize-winning combination of symbols in an underlying or primary game may result in the player being awarded one or more bonus games. Often the bonus event has a much higher probability of winning, thereby instilling a great interest by players in being awarded bonus events.

There are various secondary or "bonus" events known in the art. One such bonus event allows the player to depress a bonus spin button to allow the player one or more additional free spins in which a winning payout may be made. Alternatively, additional, discrete bonus reels may be used for the bonus event. In such case, a particular symbol on any one or more of the reels, which are stopped on a winning line, may result in a winning payout. In some bonus activities, the reels may be controllable in a bonus play, unlike the underlying primary gaming play. For example, the reels may be individually stopped, and/or the reels may be rotated slower to allow the player to attempt to stop the reel such that the prize-winning symbol stops on the win line. In another example, a bonus event for a video slot machine may have a second screen where the player is rewarded with a bonus game, such as allowing the player to pick one of five different items on the second screen, and the selected item reveals a value won by the player. In recent times, bonus events have become quite extravagant, sometimes leading the player through video animations that provide visual and audio entertainment while providing clever ways in which the participant can receive payouts of varying quantities. After engaging in the bonus event, play resumes in the underlying, primary gaming machine.

In furtherance of the need to attract casino patrons, there is a continuing need to further the excitement and visual stimulation in the participation of gaming activities. The present invention fulfills these and other needs, and offers advantages over prior art gaming approaches.

BRIEF DESCRIPTION OF THE DRAWINGS

The invention is described in connection with the embodiments illustrated in the following diagrams.

FIGS. 4A-4C illustrate an example of a sequence of events that may occur during play of the game in accordance with one embodiment of the invention;

SUMMARY OF THE INVENTION

Figure 1:
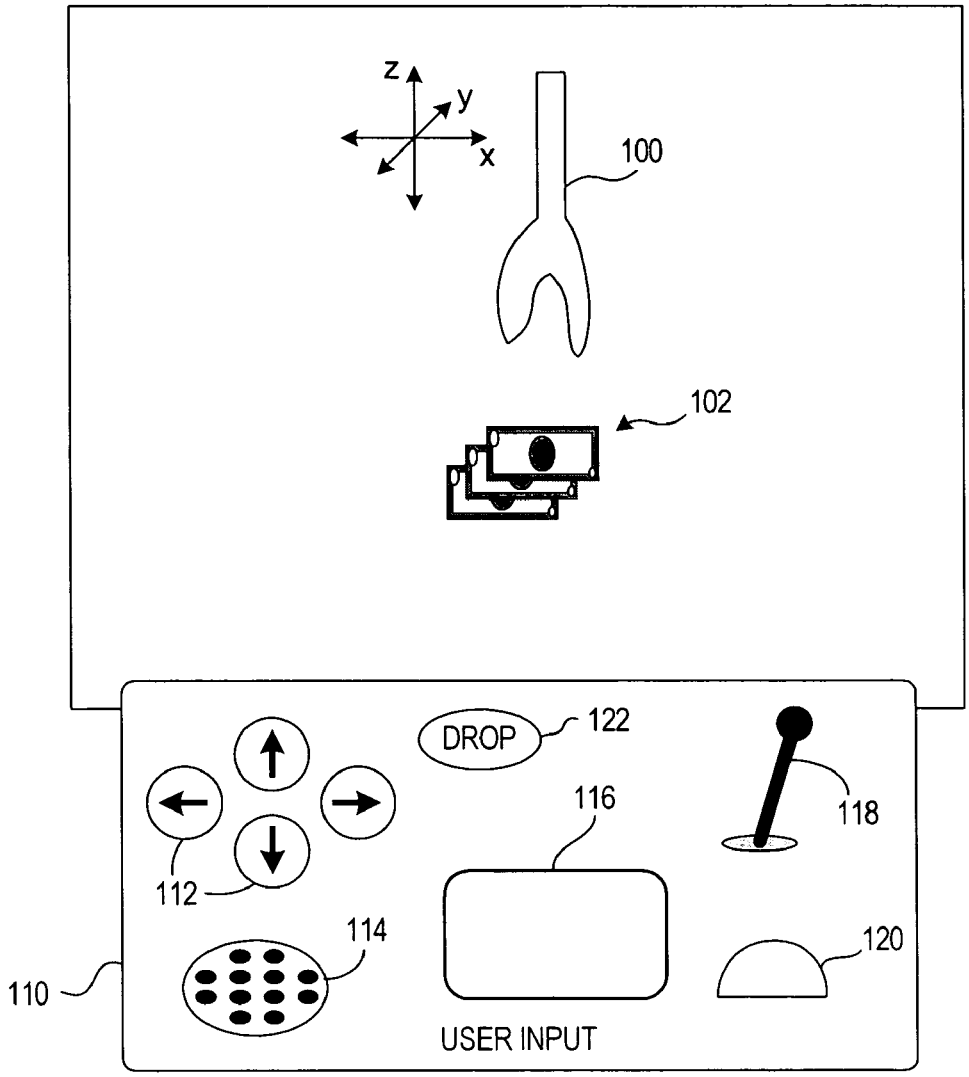
FIG. 1 generally illustrates one aspect of the invention where a retrieval mechanism is used to retrieve objects or items that are indicative of a gaming payout award.

To overcome limitations in the prior art described above, and to overcome other limitations that will become apparent upon reading and understanding the present specification, the present invention discloses apparatuses and methods for determining gaming payouts in connection with a gaming activity.

In accordance with one embodiment of the invention, a method is provided for presenting gaming payouts for a gaming activity. The method includes moving a retrieval device towards one or more perceivably selectable items among a plurality of the perceivably selectable items. A device that supports a plurality of actually selectable items is positioned such that it is substantially aligned with the retrieval device. The retrieval device retrieves at least one of the actually selectable items. A payout award is provided based on the at least one actually selectable item retrieved by the retrieval device. The gaming activity may be associated with a primary gaming activity and/or a secondary (e.g., bonus) gaming activity.

According to more particular embodiments of such a method, the method includes facilitating movement of the retrieval device proximate substantially any of the perceivably selectable items prior to moving the retrieval device towards the one or more perceivably selectable items. In one embodiment, facilitating movement of the retrieval device involves allowing movement of the retrieval device under the control of a participant of the gaming activity, where in other embodiments such movement is under system control.

According to more particular embodiments of such a method, the method involves positioning the device supporting the plurality of actually selectable items to a location substantially aligned with the retrieval device after the retrieval device has reached a position where it will be moved towards the one or more perceivably selectable items. In another embodiment, the device supporting the plurality of actually selectable items substantially follows, or substantially mirrors, positioning of the retrieval device up to a position where the retrieval device will be moved towards the one or more perceivably selectable items.

According to still more particular embodiments, the device supporting the plurality of actually selectable items may be concealed from a participant of the gaming activity. In another embodiment, at least some of the actually selectable items are associated with a payout value, and where providing a payout award involves providing a payout award based on the payout value associated with the actually selectable item retrieved by the retrieval device. In other embodiments one or more secondary award indicators may be provided to supplement the payout value, such as a multiplier.

In accordance with another embodiment of the invention, a gaming apparatus is provided for presenting gaming payouts in connection with a gaming activity. The gaming apparatus includes at least a container to hold a plurality of perceivably selectable items, a moveable retrieval device, a moveable platform to hold a plurality of actually selectable items, and a processing device(s). The processor is configured to position the moveable device towards at least one of the plurality of perceivably selectable items, to cause the moveable retrieval device to retrieve at least one of the actually selectable items, and to provide a payout award based on the retrieved actually selectable item.

In accordance with another embodiment of the invention, a method is provided for presenting gaming payouts for a gaming activity. The method involves moving a pointing device in an area proximate a plurality of potential award identifiers, stopping movement of the pointing device proximate at least one of the potential award identifiers, and providing a payout award based on the at least one of the potential award identifiers identified by the pointing device when the pointing device has stopped proximate the at least one of the potential award identifiers.

DETAILED DESCRIPTION OF THE INVENTION

This document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

In the following description of various exemplary embodiments, reference is made to the accompanying drawings which form a part hereof, and in which is shown by way of illustration various embodiments in which the invention may be practiced. It is to be understood that other embodiments may be utilized, as structural and operational changes may be made without departing from the scope of the present invention.

Generally, the present invention provides a manner for presenting payouts in gaming activities. The invention may be used in connection with primary gaming activity and/or in connection with secondary/bonus activity. The invention provides a controllable selection and/or item capture mechanism used to identify full or partial payout values, and/or other play parameters such as multipliers, continue/discontinue identifiers, etc. The system and/or the user can control the selection/capture mechanism.

FIG. 1 generally illustrates one aspect of the invention where a retrieval mechanism 100, depicted as a claw in the illustrated embodiment, is used to retrieve objects or items that are indicative of a gaming payout award. In one embodiment of the invention, the player is allowed to control the retrieval mechanism. The user can also control when, and in some embodiments how, the retrieval mechanism will be positioned (e.g., dropped) proximate the selectable items 102. For example, when the retrieval mechanism 100 is positioned where the player wants it, the player may cause the retrieval mechanism 100 to drop towards the selectable items 102 in order to select one or more of the selectable items 102. Depending on which item 102 is selected, the payout award and/or further play characteristics will be identified. In other embodiments, the system controls some or all of the movement, such that the user controls only some or none of the movement of the retrieval mechanism 100.

The selectable items may be items with indicia indicative of a payout amount, prizes, tickets, etc. The selectable items may instead, or in addition, indicate play parameters such as "try again," "stop," or other indications relevant to further play of the game. The selectable items may instead, or in addition, indicate mathematical functions such as multipliers and the like.

The retrieval mechanism 100 may be a claw-like member such as depicted in FIG. 1. Alternatively, any retrieval mechanism may be used. For example, rather than a claw, a magnetic retrieval mechanism 100 may be used, slot and groove, or other adherence mechanisms. In the illustrated embodiment, the retrieval mechanism 100 represents a claw capable of grasping any one or more of the selectable items 102. In some embodiments, multiple retrieval mechanisms 100 may be utilized. The retrieval mechanism 100 may be moved left, right, front, back diagonally, up, down, etc.

A user interface 110 is provided in one embodiment to allow the user to control at least some of the movement of the retrieval mechanism 100. For example, the movement of the retrieval mechanism 100 may be controlled using, for example, directional buttons 112, microphone 114 and associated logic to recognize and act on voice commands, a touch screen or touch pad 116, joystick 118, mouse or trackball 120, or any other UI mechanism. A "DROP" button or other UI mechanism may be used instead, or in addition to other UI mechanisms, to cause the retrieval mechanism 100 to move downward to retrieve one or more items. Alternatively, the retrieval mechanism 100 may be system controlled, where a random number generation engine may be used to at least in part determine to which location(s) the retrieval mechanism 100 will be presented.

Figure 2A:
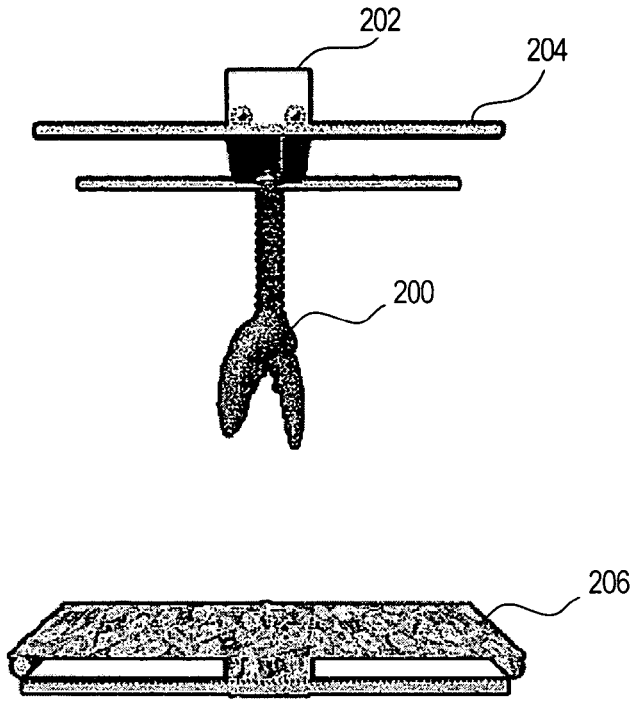
FIGS. 2A and 2B illustrate representative embodiments of a retrieval mechanism in the form of a claw-like member.
Figure 2B:
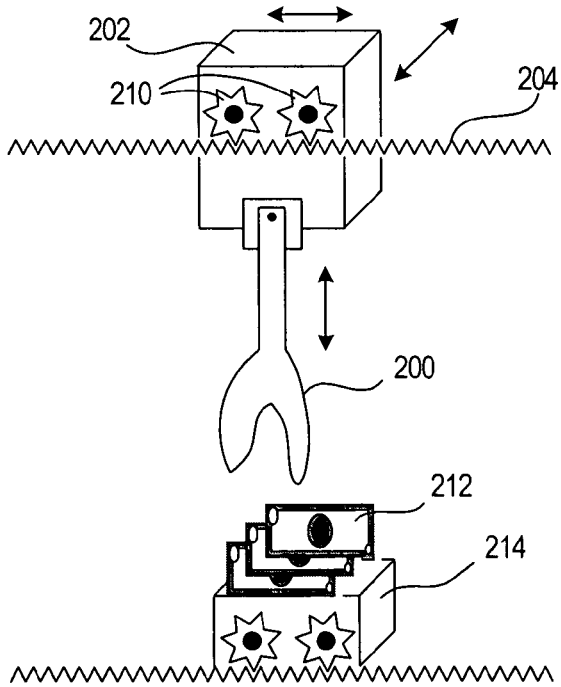

FIGS. 2A and 2B illustrate representative embodiments of a retrieval mechanism in the form of a claw-like member 200. As shown in FIG. 2A, the claw 200 may be coupled to a structure 202 that moves along one or more tracks 204 to position the claw 200 at the desired position. For example, the claw 200 may move right-to-left and left-to-right along the track 204, and the track 204 itself may be moved front-to-back and back-to-front. In this manner, the claw 200 can reach any X-Y coordinates. Further, the claw 200 may be coupled to a rod, wire, or other suspension member to allow the claw 200 to move up and down in the Z direction to retrieve selectable items at the item area 206.

FIG. 2B provides a more particular embodiment of such a retrieval mechanism. Again, the claw 200 is coupled to a structure 202. In this embodiment, the structure 202 includes one or more gears 210 for engaging the track 204 and allowing the structure 202, and consequently the claw 200, to move. By moving the track 204 front/back, motion is allowed in both the X-Y directions. Finally, the claw 200 can be moved to and from the selectable items 212.

Because gaming systems are generally designed to produce random results without introducing player skill, one embodiment of the invention involves providing a plurality of "actual" selectable items relative to "perceivable" selectable items. In other words, while many items may be presented to have the appearance of being selectable, the random number generation engine will determine which of the selectable items is to be presented for a particular game play. Therefore, a platform 214 or "cash box" may be provided which is used to position the actual selectable items at the point of claw selection, whether that claw selection be user or system controlled. In one embodiment, the cash box 214 is moved to the appropriate location after the claw has reached a position where it will be dropped. In another embodiment, the cash box 214 in essence mirrors the movement of the claw 200 or other retrieval mechanism. In this manner, one (or more) of the actual selectable items associated with the cash box 214 can be controllably delivered to the claw 200 to provide the appropriate payout amount or other result.

For example, assume the selectable items to be representations of various monetary bills, such as $1, $5, $10, $50, $100, etc. Such bills may be gathered at the bottom, or may be blown around in an enclosure. Many of these bills are perceivably selectable items to the user, i.e., they appear to be items that can be selected by the claw 200. However, since a level of control over which monetary amount is to be chosen as a payout award, the cash box 214 can be used to essentially deliver the appropriate bill, an "actual" selectable item to the retrieval mechanism 200. For example, if the random number generation engine determines that the player is entitled to a $50 payout for the particular gaming activity, the cash box 214 may provide a $50 bill (or representation of a $50 bill) to the claw mechanism 200. When the claw 200 raises, it will have a $50 bill in its grasp, thereby indicating to the player that s/he has won a $50 payout. In such an embodiment, the system will know what denomination is being delivered to the claw 200, and therefore the presentation is for the player's benefit. Thus, in such an embodiment, the cash box 214 represents a delivery and retrieval device that is calibrated to the movements of the claw 200, allowing the claw 200 to grab a specific item(s) from the cash box 214. A moving barrier may be used to separate the space that the cash box 214 occupies from pseudo-selectable items (i.e., perceivable selectable items) displayed to the player.

In one embodiment of the invention, the retrieval mechanism 200 reads an electronic signature or other electronic indication of the retrieved items. Such electronic information may be utilized to inventory items, and/or to determine item amounts. For example, the cash box may provide a number of actual selectable items, the retrieval mechanism 200 grabs one (or more), and the retrieval mechanism 200 reads the electronic information from the selected item(s) to determine the payout amount. For example, the items may be bar-coded, or technologies may be used such as infrared, electromagnetic, radio frequency identification (RFID), etc. In the case of RFID, each item includes an RFID tag, while the retrieval mechanism includes an RFID reader to read the identifying information from the item. Such embodiments are particularly beneficial where the item is actually dispensed to the player (e.g., a prize, etc.) where inventory may be necessary or otherwise desirable. Similarly, such technologies may be used to determine which of the items will be selected. In other words, if a plurality of available items are provided via the cash box 214, the appropriate one (or more) of the selectable items may be determined at the time of selection using such technologies. For example, if the RNG determines that the payout is to be $50, the retrieval mechanism 200 can electronically determine which of the selectable items in the cash box 214 corresponds to $50.

Figure 3B:
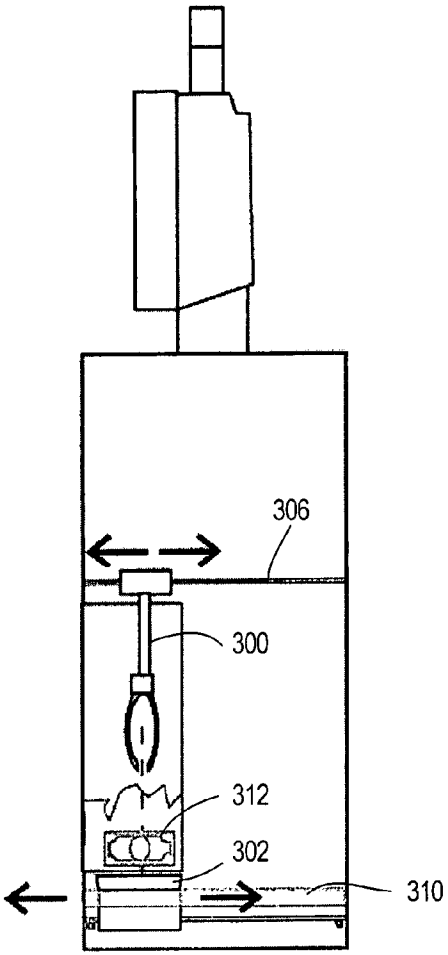
FIGS. 3A and 3B illustrate one embodiment of a moveable retrieval mechanism and cash box in accordance with the invention.
Figure 3A:
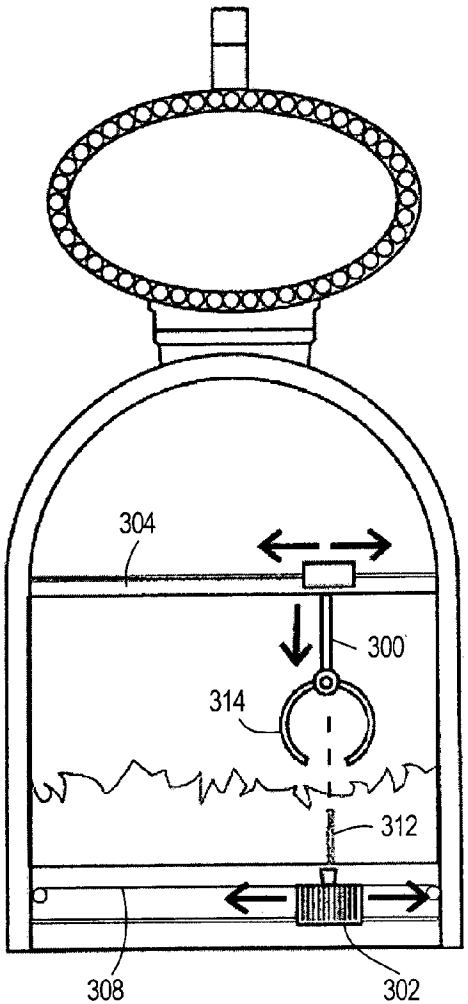

FIGS. 3A and 3B illustrate one embodiment of a moveable retrieval mechanism 300 and cash box 302 in accordance with the invention. In this embodiment, the retrieval mechanism 300, a claw device in the illustrated embodiment, can move from left-to-right and right-to-left along a first track 304, and from front-to-back and back-to-front along a second track 306. In the illustrated embodiment, the cash box 302 is also moveable along first and second tracks 308, 310 to mirror the movements of the retrieval mechanism 300. An item 312 to be provided to the player is positioned for delivery to the retrieval mechanism 300, such that when the grasping mechanism 314 associated with the retrieval mechanism 300 is positioned proximate the item 312, it can grasp and retrieve the item 312. In one embodiment, the cash box 302 provides the appropriate item to be grasped by the retrieval mechanism 300, where in another embodiment the cash box 302 provides a number of items available for selection and the retrieval mechanism 300 selects one of those allowable items.

FIGS. 4A-4C illustrate an example of a sequence of events that may occur during play of the game in accordance with one embodiment of the invention. FIGS. 4A-4C use common reference numbers where appropriate to facilitate the description of operation. The operation described in connection with FIGS. 4A-4C may be performed in connection with a primary gaming activity, or alternatively may be provided in connection with a secondary/bonus activity.

The example of FIGS. 4A-4C assume the retrieval mechanism 400 is a claw mechanism, and the selectable items are representations of monetary bills (e.g., $1, $5, $10, $20, etc.) Referring to FIG. 4A, the game play in the illustrated embodiment begins with some bills being blown by a fan or otherwise flying about an encapsulated box 402. Using user interface 404, the player can move the retrieval mechanism 400. As shown in FIG. 4B, the user can cause the retrieval mechanism 400 to drop to the bills (or more precisely to the cash box; not shown) using another UI mechanism such as the DROP button 406. The retrieval mechanism 400 then presents the item 408 which is indicative of the payout award that is provided, if any.

FIG. 4D illustrates another embodiment similar to FIG. 4C, but multiplier values are also provided. For example, assume that the retrieval mechanism 400 retrieves item 410, which indicates a payout amount of $5. Multiplier values may also be provided, and in the illustrated embodiment such multipliers are provided by lighting or otherwise designating one of the plurality of multiplier indicators 412. In the illustrated embodiment, multiplier indicator 414 has been selected, which indicates a 150× multiplier. The total payout to the player is then 150×$5=$750. In one embodiment, various multiplier indicators 412 flash on and off, the item 410 is selected, and one of the multipliers remains lit or otherwise highlighted to indicate the multiplier amount. The multiplier may be designated before, after, or substantially contemporaneously with selection of the item 410.

Figure 5:
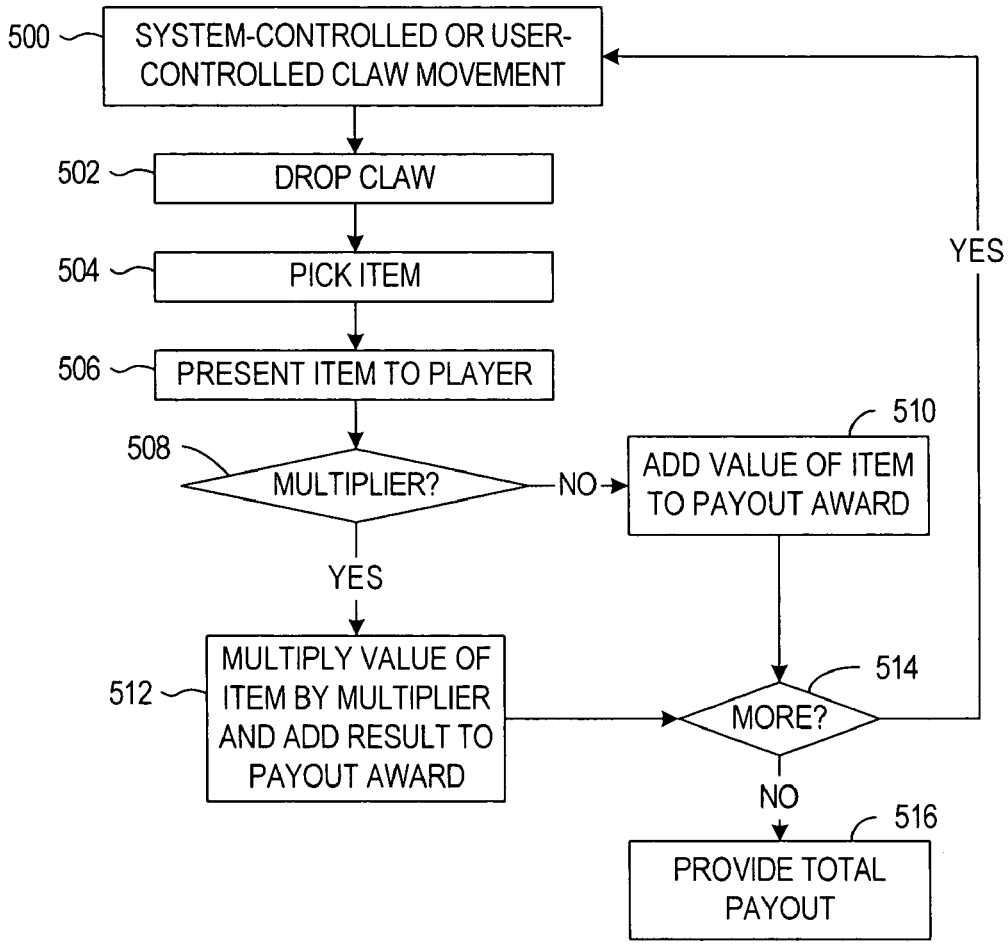
FIG. 5 is a flow diagram illustrating one embodiment of a method for determining gaming payout awards in accordance with the present invention.

FIG. 5 is a flow diagram illustrating one embodiment of a method for determining gaming payout awards in accordance with the present invention. The player and/or system controls claw or other retrieval mechanism movement as shown at block 500. The player/system brings the claw or other retrieval mechanism towards the selectable items, such as by dropping 502 the claw. The retrieval mechanism picks 504 an item and presents 506 it to the player. If there is no multiplier awarded as determined at decision block 508, the value of the selected item is added 510 to the payout award. If a multiplier was awarded, the value of the item is multiplied by the multiplier and the result is added to the payout award as shown at block 512. If additional item retrievals have been granted, play can continue as depicted by the loop back to block 500. Otherwise, the total payout is provided 516, such as adding the amount to an accumulated credit total or otherwise paying the player.

Figure 6:
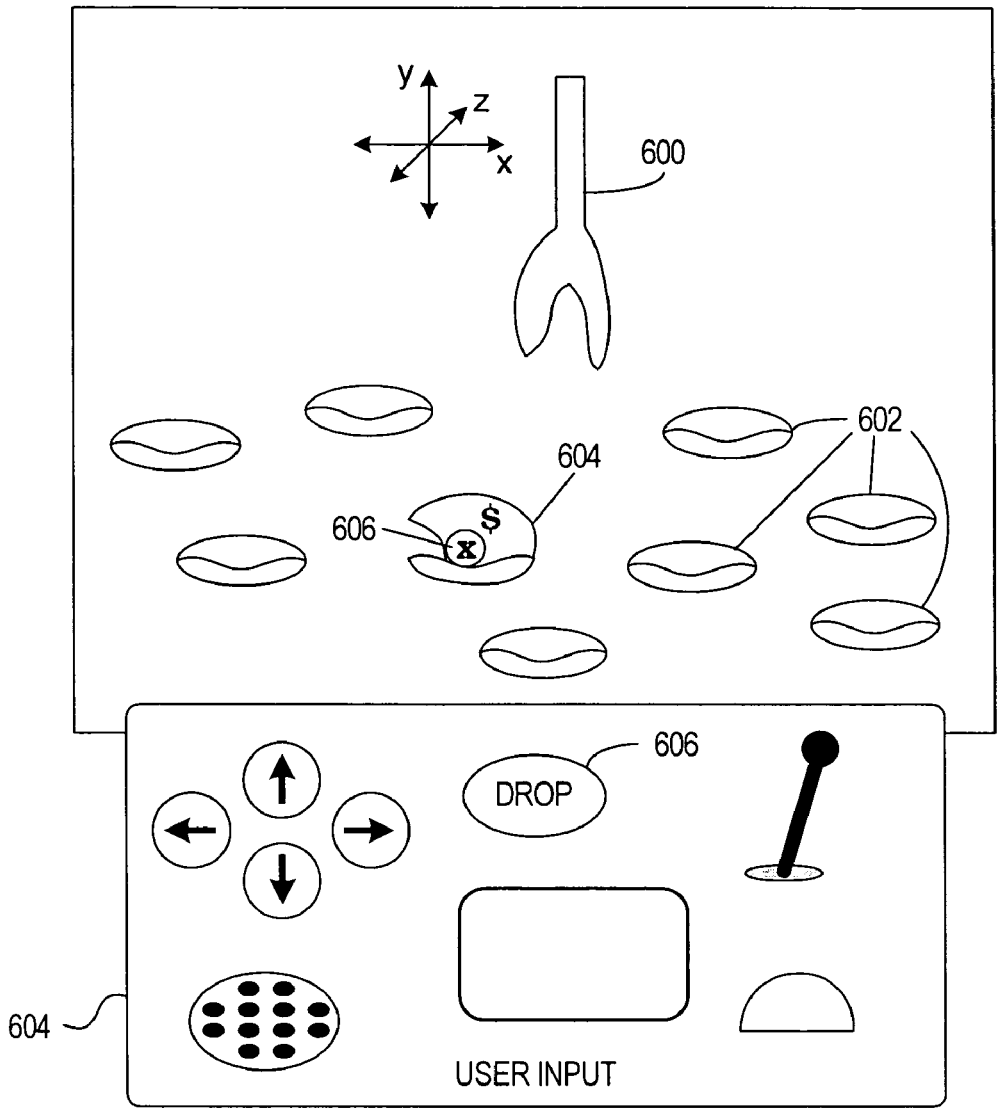
FIG. 6 illustrates another embodiment of the invention, where the retrieval mechanism serves as a pointing device to identify an award value(s) and/or multipliers or other play parameters.

The present invention may be implemented in various manners. FIG. 6 illustrates another embodiment of the invention, where the retrieval mechanism 600 serves as a pointing device to identify an award value(s) and/or multipliers or other play parameters. In the illustrated embodiment of FIG. 6, the retrieval mechanism 600 is again moveable as previously discussed. Such movement may be effected by the system and/or the player. For example, the user may be allowed to move the mechanism 600 around the area to ultimately place the mechanism 600 proximate (e.g., placed over) one of the selectable items 602. The UI 604 may be used by the player to perform such movement. By pressing the DROP button 606 or other analogous UI function, the mechanism 600 can identify the closest item 602 as the selected item, or may move downward to select the item, or may even move to the selected item and open it to reveal the winning payout amount.

In another embodiment, the movement of the mechanism 600 is system controlled, and may move from item-to-item before stopping proximate one (or more) of the items 602. In this embodiment, because the user does not control which item will be selected, each of the items may reveal its award value as the mechanism 600 passes over it. For example, where the selectable items are representations of clams, the clam may open as the mechanism 600 passes over it, and the underside of the clam shell can expose its award value. When the mechanism moves on to another location, the clam will again close, thereby indicating that it has not been selected.

When the mechanism 600 stops at an item 602 or otherwise performs a predetermined action indicating that an item has been selected, the award value identified by the item is awarded to the player. For example, if the mechanism 600 stops above item 604, an award value (depicted by "$") is provided to the player. In one embodiment, a secondary award indicator may be provided, such as a second award value, a multiplier, or the like. In the illustrated embodiment and keeping with the theme of clams, the secondary award indicator is depicted as a pearl 606. To add excitement and anticipation to the game play, the pearl may be turned such that a multiplier value is not visible. In such a case, the mechanism 600, a claw in the illustrated embodiment, moves down to the pearl 606 and turns the pearl 606 or otherwise exposes its multiplier (depicted by "×"). The payout amount to the player is then the award value ($) times the multiplier (×) to arrive at the payout result. Multipliers may be provided in other manners as well.

FIG. 7A illustrates a representative gaming machine 700 having a primary gaming activity 702 and a secondary/bonus gaming activity 704. The primary gaming activity may be any desired primary gaming activity, such as a slot game as shown in FIG. 7B. The bonus event 704 is shown more clearly in FIG. 7C, and as can be seen includes a retrieval mechanism 706 and a plurality of selectable items 708.

Figure 7K:
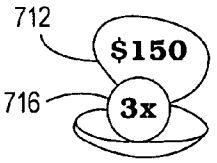
FIG. 7A illustrates a representative gaming machine having a primary gaming activity and a secondary/bonus gaming activity.
FIGS. 7B and 7C illustrate the primary and secondary gaming activities of FIG. 7A.
FIGS. 7D-7J illustrate an example of a sequence of events that may occur during play of the game in accordance with one embodiment of the invention.
Figure 7H:
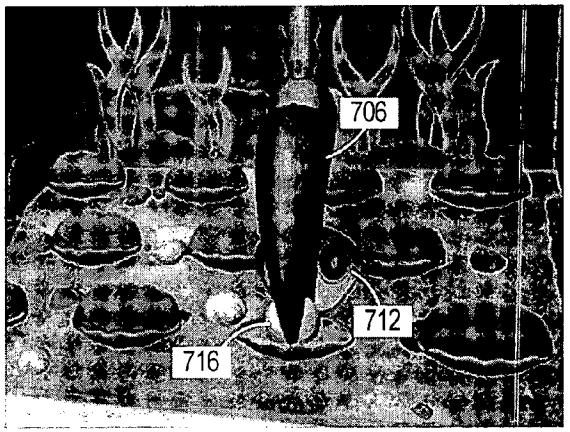
Figure 7J:
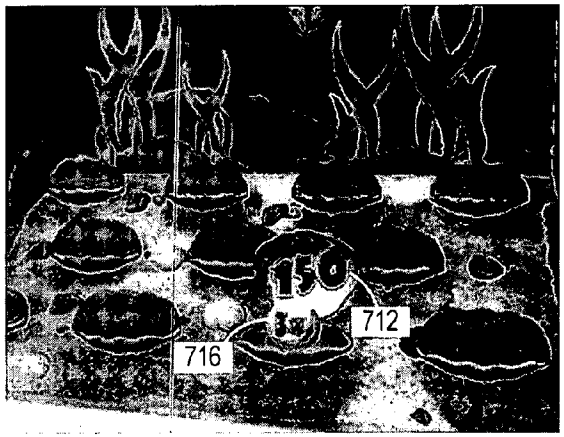
Figure 7G:
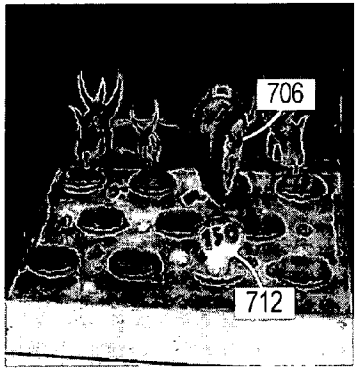
Figure 7I:
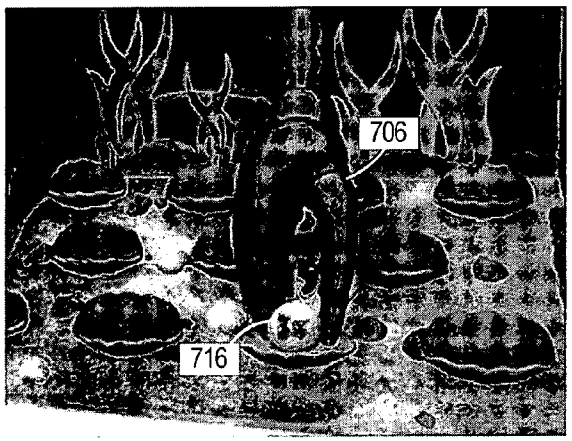

FIGS. 7D-7J illustrate an example of a sequence of events that may occur during play of the game in accordance with one embodiment of the invention. In FIG. 7D, the retrieval mechanism 706, seen as a claw such as a lobster claw, moves proximate a selectable item 710, which is a clam in the illustrated embodiment. When the claw 706 moves over the item 710, the clam shell opens and reveals an award amount of 50 (e.g., 50 credits). The claw, however, continues moving and the clam 710 closes as seen in FIG. 7E. In one embodiment the amount of 50 credits may be provided to the player, but in the illustrated embodiment the amount at clam 710 was revealed but not awarded. The claw 706 is now positioned over clam 712, which opens and reveals an award amount of 150 credits. The claw 706 continues to move as shown in FIG. 7F, where clam is now opened and revealing a 500 credit potential award. However, the claw 706 continues moving and goes back to clam 712 and drops down to the clam 712, thereby indicating this is the award that is presented to the player. This is seen in FIG. 7H. Also shown in FIG. 7H is the claw 706 grasping the "pearl" or other associated item representing a multiplier value. The claw 706 turns the pearl 716 to reveal the multiplier (3×), as shown in FIG. 7I. The result is shown in FIG. 7J, where the selected item (clam 712) provides an award of 150 credits, and the pearl 716 provides a multiplier of 3×, for a result of 150×3=450 credits. This is shown more clearly in FIG. 7K.

Figure 8:
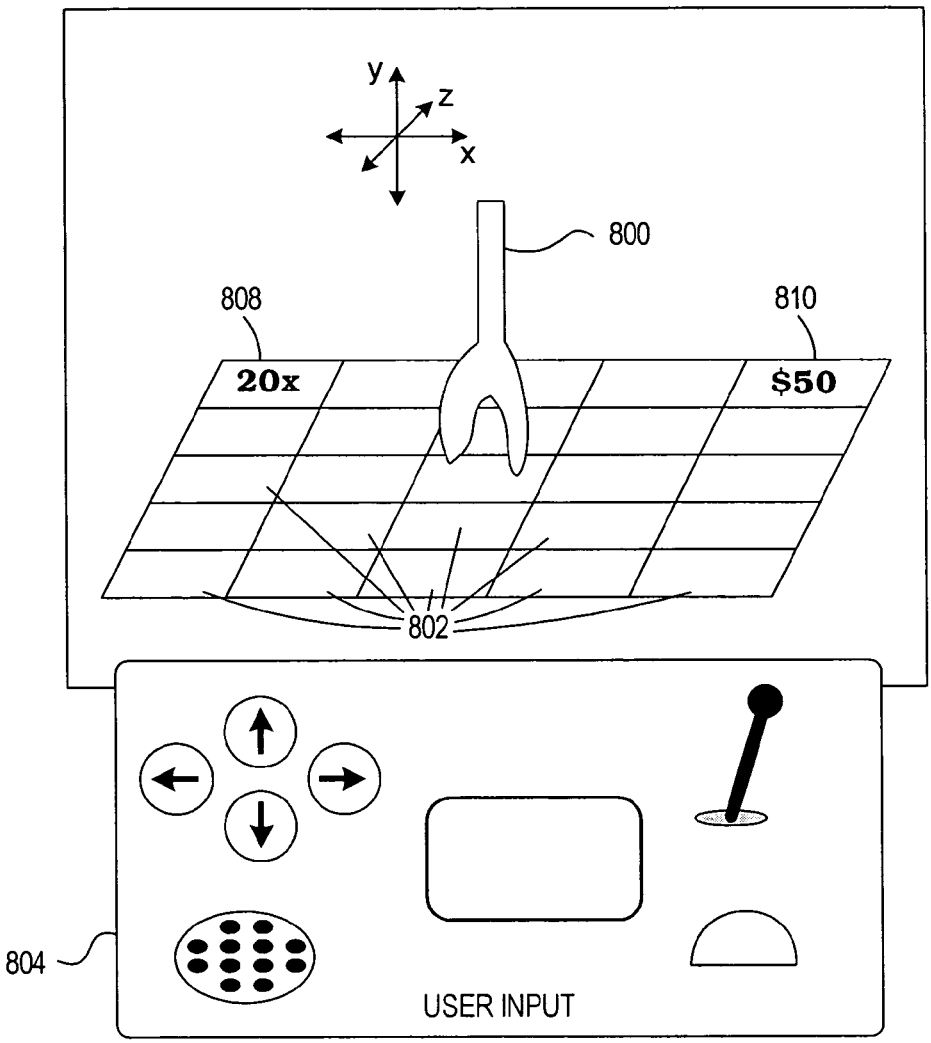
FIG. 8 illustrates another embodiment of the invention, where the retrieval mechanism again serves as a pointing device to identify an award value(s) and/or multipliers or other play parameters.

The present invention may be implemented in still other manners. FIG. 8 illustrates another embodiment of the invention, where the retrieval mechanism 800 again serves as a pointing device to identify an award value(s) and/or multipliers or other play parameters. In the illustrated embodiment of FIG. 8, the retrieval mechanism 800 is again moveable as previously discussed. Such movement may be effected by the system and/or the player. For example, the user may be allowed to move the mechanism 800 around the area to ultimately place the mechanism 800 proximate (e.g., placed over) one of the selectable items 802. The UI 804 may be used by the player to perform such movement. By pressing the DROP button 806 or other analogous UI function, the mechanism 800 can identify the closest item 802 as the selected item, or may move downward to select the item, or may even move to the selected item and open it to reveal the winning payout amount. A user-controlled embodiment would generally involve hiding or otherwise disguising the values/parameters associated with the selectable items 802.

In one embodiment, movement of the mechanism 800 is system controlled, and through the use of an RNG determines which location will be selected. However, the mechanism moves from place to place, increasing anticipation of which item will be selected. In one embodiment, the selectable item that is most closely associated with the mechanism 800 lights up, flashes, or is otherwise distinguished from the other selectable items 802. At some point, the mechanism 800 stops by a particular selectable item, and that becomes the award value, multiplier, etc. for that game play.

As depicted by selectable items 808, 810, the selectable item may provide a payout amount, a multiplier, or other result. For example, item 808 provides a multiplier value of 20 (20×). Item 810 provides an award value of $50. In one embodiment of the invention, substantially all of the selectable items 802 are multiplier values, and the gaming activity is used as a bonus event for a primary gaming activity. For example, the player may receive a 20 credit award in connection with a primary gaming activity, and in addition is awarded a bonus activity as shown in FIG. 8. The multiplier that is selected via the gaming activity shown in FIG. 8 therefore serves as a multiplier to the player's award obtained during the primary gaming activity. For example, if the player received a 20 credit award during the primary gaming activity, and a 20× multiplier 808, the player would receive a total of 20×20=400 credits.

In one embodiment only one such selection by the mechanism 800 is provided, while in other embodiments additional selections may be made. For example, one embodiment involves a first selection of a value, and a second selection of a multiplier. Other embodiments may involve still further selections.

Figure 9A:
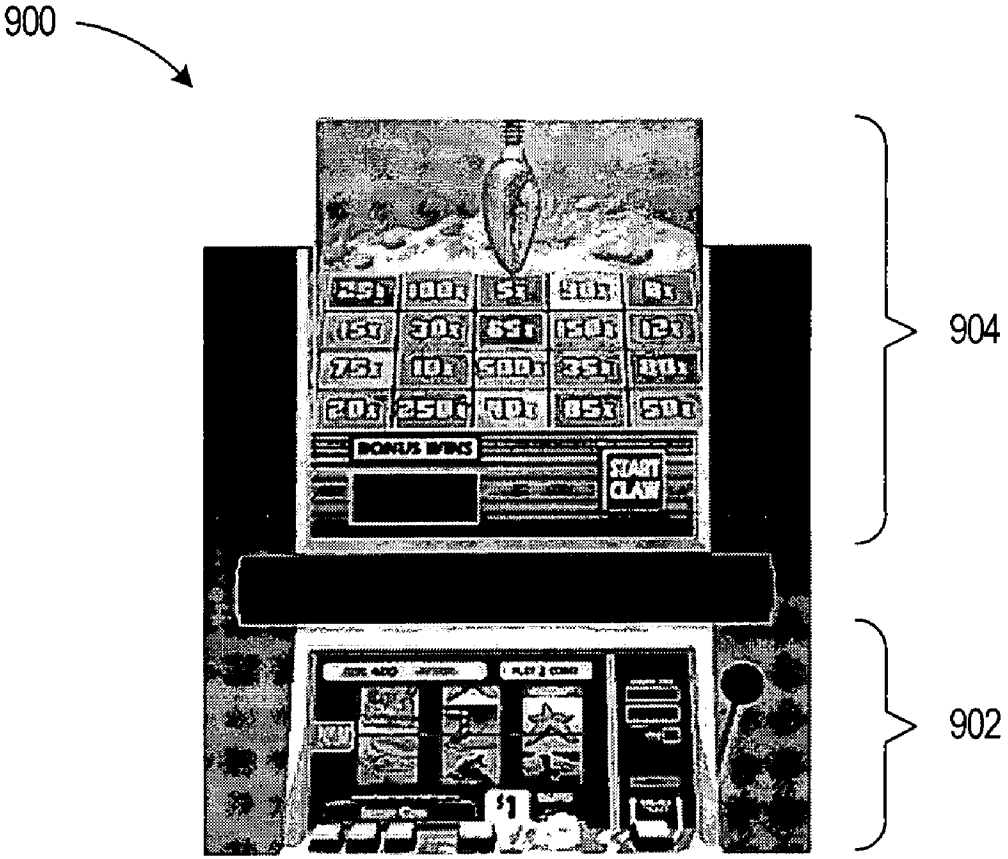
FIG. 9A illustrates a representative gaming machine having a primary gaming activity and a secondary/bonus gaming activity.
Figure 9B:
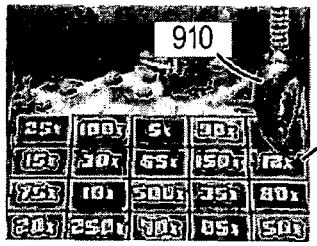
FIGS. 9B-9G illustrate an example of a sequence of events that may occur during play of the game in accordance with one embodiment of the invention.
Figure 9C:
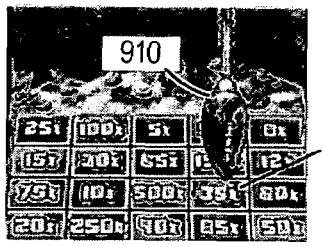
Figure 9D:
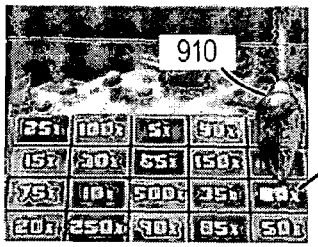
Figure 9E:
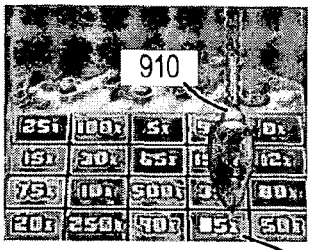
Figure 9F:
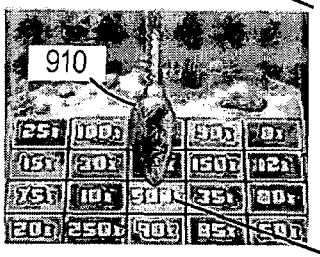
Figure 9G:
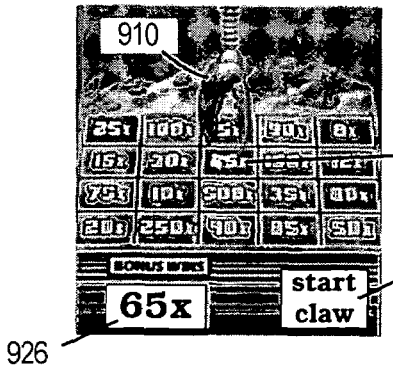

FIG. 9A illustrates a representative gaming machine 900 having a primary gaming activity 902 and a secondary/bonus gaming activity 904. The primary gaming activity may be any desired primary gaming activity, such as a slot game. FIGS. 9B-9G illustrate an example of a sequence of events that may occur during play of the game in accordance with one embodiment of the invention. As shown in FIG. 9B, the pointing mechanism, a claw 910 in the illustrated embodiment, moves proximate a first selectable item 912. The claw may be initiated automatically, or by the user activating a UI mechanism such as the "start claw" button 914 shown in FIG. 9G. The claw can move from selectable item to selectable item. This is depicted the movement from item 912 in FIG. 9B to item 916 in FIG. 9C. The claw 910 continues moving to items 918, 920, 922, and 924 as shown in the progression of events in FIGS. 9D-9G. Some identifying feature may be performed to indicate when the claw 910 has selected an item, such as the claw 910 opening/closing its pinchers. This is illustrated in FIG. 9G, where the claw 910 has positioned itself over item 914, which corresponds to a multiplier of 85× in the illustrated embodiment. This multiplier is then used to multiply an award value already obtained, or yet to be obtained, by the player either in the primary or bonus mode of play. The received multiplier may be displayed as shown at display area 926.

The claw 910 may slow down as it begins to near its ultimate selection, to add excitement and anticipation. Further, when the claw passes over a selectable item, it may be lit up or otherwise distinguished from the other selectable items. Multiple pointers may also be used, such as one for a value and one for a multiplier. It is also noted that other pointing devices other than the claw may alternatively be used. Further, any number of terminating events may be employed to determine when the gaming activity has concluded. For example a single selection may be all that is allowed, or a predetermined or random number of such selections may be allowed.

As previously indicated, the present invention may be implemented as a primary gaming activity or a bonus gaming activity. Thus, the player may participate in a primary gaming activity, which may include any desired gaming activity such as slot games, poker games, or other conventional games played on slot machine-style games. For example, the system may be a mechanical or video slot machine having a plurality of reels, and having one or more paylines. When any of one or more predetermined symbol combinations occurs via the primary gaming activity, the player will be allowed to enter a secondary or "bonus" activity. If the player does not meet the bonus activity criteria (e.g., hit a particular symbol combination in a slot game), the player remains in the standard/primary play mode. Otherwise, the player enters the bonus round, where the player may then participate in the gaming activity of the present invention.

Figure 10:
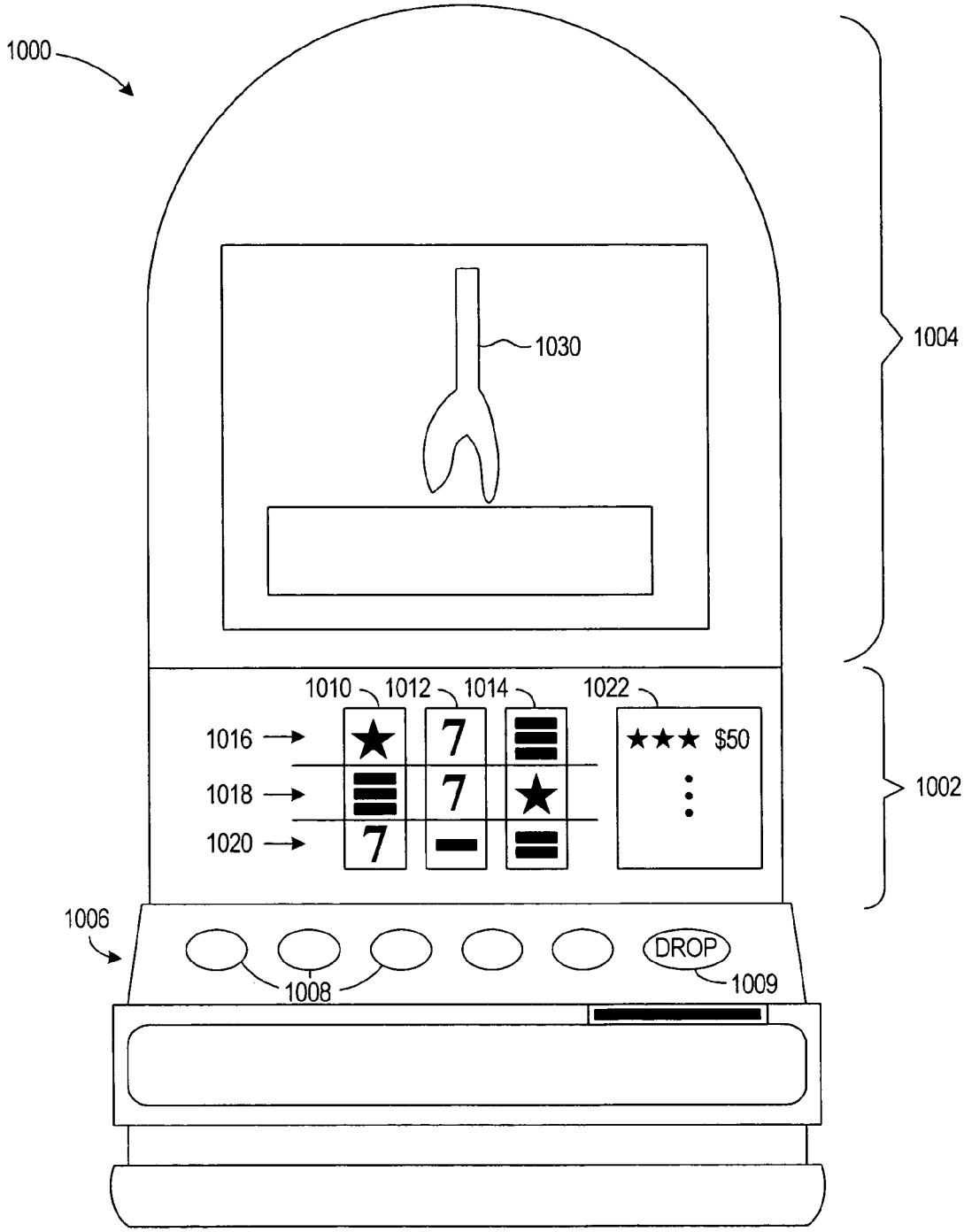
FIG. 10 is an embodiment of a casino-style gaming device in which the principles of the present invention may be applied as such a bonus activity.

FIG. 10 is an embodiment of a casino-style gaming device in which the principles of the present invention may be applied as such a bonus activity. Many traditional casino table games may be provided in a "video game" available via a casino-style gaming device shown in FIG. 10. For purposes of explanation, the description of the gaming device is FIG. 10 is provided in terms of a slot machine 1000. However, the present invention is analogously applicable to other casino-style games (video poker, video bingo, etc.) having the ability to include at least one bonus activity.

The slot machine 1000 is a structure including at least a primary gaming activity presentation 1002 and a bonus activity presentation 1004. The slot machine 1000 includes a housing for embodiments having a self-supported, independent structure. A user interface 1006 is provided to allow the user to control and engage in play of the slot machine 1000. The particular user interface mechanisms associated with user interface 1006 is dependent on the type of gaming machine. For example, the user interface 1006 may include one or more buttons, switches, joysticks, levers, pull-down handles, trackballs, voice-activated input, or any other user input system or mechanism that allows the user to play the particular gaming activity. The user input 1006 allows the user to enter coins or otherwise obtain credits through vouchers, tokens, credit cards, etc. Various mechanisms for entering such vouchers, tokens, credit cards, coins, etc. are known in the art. For example, coin/token input mechanisms, card readers, credit card readers, smart card readers, punch card readers, and other mechanisms may be used to enter wagers. It is through the user input 1006 that the user can initiate the standard mode of play, and in some embodiments may optionally control certain aspects of the bonus mode of play, such as controlling the movement of the retrieval mechanism, pointing mechanism, etc. In the case of a slot machine, the user input may include a plurality of buttons, e.g., button 1008, which allow the user to enter a number of credits to play, identify the number of paylines in which to participate, cash out, automatically bet the maximum amount and paylines, etc. For example, the DROP button 1009 may be used to allow the user to indicate when the retrieval/pointing mechanism should drop to make a selection. It should be recognized that a wide variety of other user interface options are available for use in connection with the present invention, including pressing a button on a gaming machine, touching a segment of a touch-screen, entering text, entering voice commands, or other known user entry methodology. The particular user interface mechanism employed is not relevant to the present invention.

The primary gaming activity presentation 1002 may be provided via a video display device or via mechanical reels. In the case of a video display device, the display device may take on a variety of forms depending on what type of presentation is to be provided. For example, a standard slot gaming activity includes multiple reels 1010, 1012, 1014, and in the illustrated embodiment three paylines 1016, 1018, 1020 are provided. Any number of paylines and/or reels may be provided where the primary gaming activity is a slot game.

Also associated with the gaming device 1000 may be a pay table 1022, where information associated with the potential winning symbol combinations of the standard slot game activity may be presented. This area may also provide an indication of the requisite symbols, symbol combinations, symbol locations, etc. that are required to invoke the bonus mode in accordance with the invention. This information may be part of a display screen, or alternatively may be separate from the display screen and provided directly on a portion of the structure itself. For example, a backlit colored panel may be used as the winning guide area.

When the player achieves the requisite bonus qualifying criteria via the primary gaming activity, the player will be allowed to participate in the bonus activity in accordance with the present invention. The bonus activity illustrated in FIG. 10 is a retrieval and/or pointing mechanism 1030 to identify payout values and/or play parameters as previously described. It should be noted that a dispenser area (not shown) may also be provided to dispense awarded items in embodiments where retrieved items are actually dispensed to the player (e.g., stuffed animals, jewelry, etc.)

Figure 11:
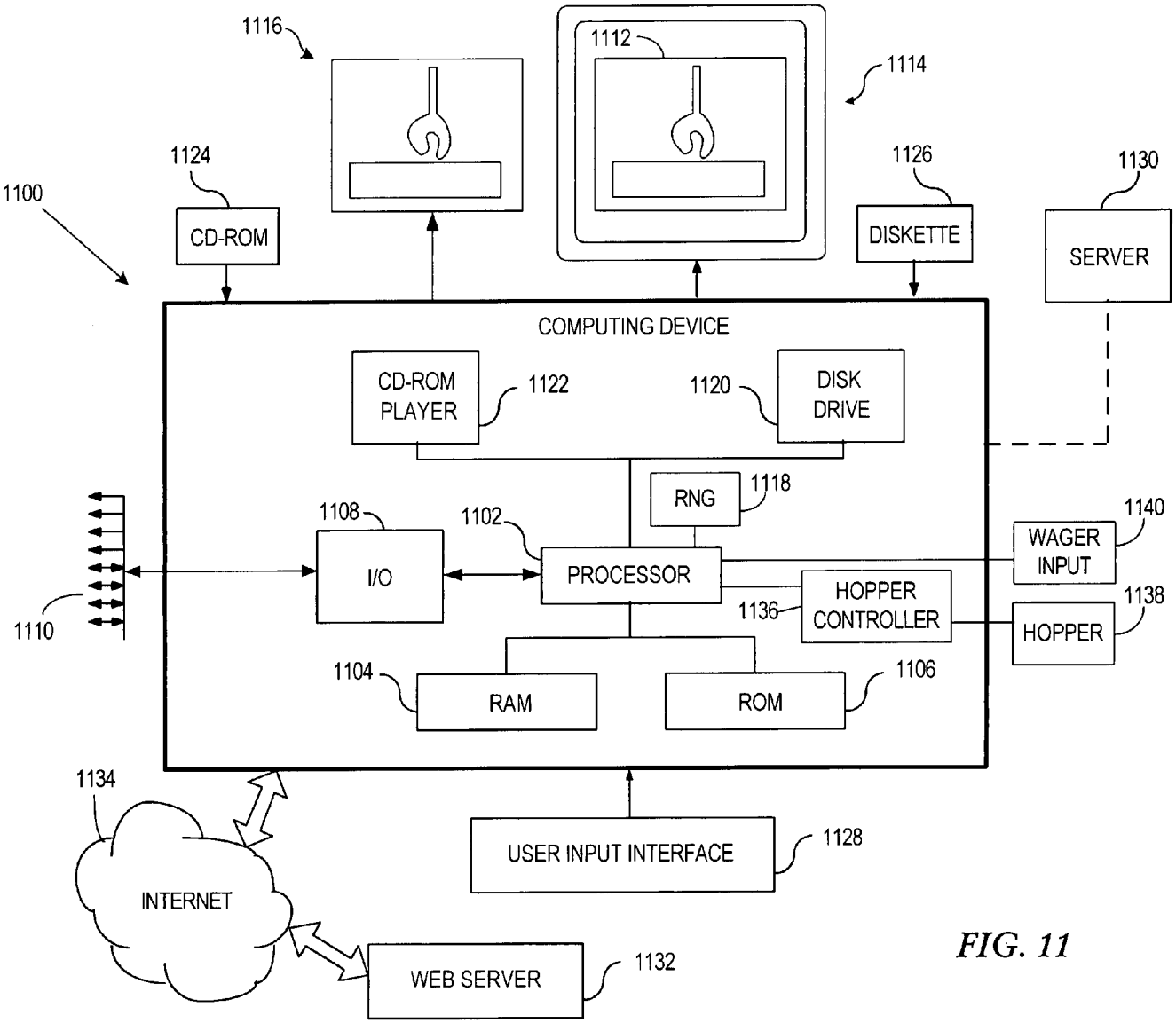
FIG. 11 illustrates a representative computing system capable of carrying out operations in accordance with the invention.

The gaming machines described in connection with the present invention may be independent casino gaming machines, such as slot machines or other special purpose gaming kiosks, video games, or may be computing systems operating under the direction of local gaming software and/or remotely-provided software such as provided by an application service provider (ASP). The casino gaming machines utilize computing systems to control and manage the gaming activity. An example of a representative computing system capable of carrying out operations in accordance with the invention is illustrated in FIG. 11.

Hardware, firmware, software or a combination thereof may be used to perform the various gaming functions and operations described herein. The functional modules used in connection with the invention may reside in a gaming machine as described, or may alternatively reside on a stand-alone or networked computer. The computing structure 1100 of FIG. 11 is an example computing structure that can be used in connection with the primary gaming activity and/or bonus gaming activity for such electronic gaming machines.

The example computing arrangement 1100 suitable for performing the gaming activity in accordance with the present invention may include a central processor (CPU) 1102 coupled to random access memory (RAM) 1104 and some variation of read-only memory (ROM) 1106. The ROM 1106 may also be other types of storage media to store programs, such as programmable ROM (PROM), erasable PROM (EPROM), etc. The processor 1102 may communicate with other internal and external components through input/output (I/O) circuitry 1108 and bussing 1110, to provide control signals, communication signals, and the like.

Chance-based gaming systems such as slot machines, in which the present invention is applicable, are generally governed by random numbers and processors. Control of the retrieval/pointing mechanism 1112 on a display 1114, and/or control of mechanical retrieval/pointing mechanism 1116 in accordance with the invention are provided in part by a random number generator (RNG). RNGs are well-known in the art, and may be implemented using hardware, software operable in connection with the processor 1102, or some combination of hardware and software. In accordance with generally known technology in the field of slot machines, the processor 1102 associated with the slot machine, under appropriate program instruction, can simulate the actions to be presented as well as the movement of the retrieval/pointing mechanisms. The present invention is operable using any known RNG, and may be integrally programmed as part of the processor 1102 operation, or alternatively may be a separate RNG controller 1118. RNGs are well known in the art, and any type of RNG may be implemented for the standard mode of play and/or the bonus mode of play in accordance with the invention.

The computing arrangement 1100 may also include one or more data storage devices, including hard and floppy disk drives 1120, CD-ROM drives 1122, and other hardware capable of reading and/or storing information such as DVD, etc. In one embodiment, software for carrying out the standard and/or bonus gaming operations in accordance with the present invention may be stored and distributed on a CD-ROM 1124, diskette 1126 or other form of media capable of portably storing information. These storage media may be inserted into, and read by, devices such as the CD-ROM drive 1122, the disk drive 1120, etc. The software may also be transmitted to the computing arrangement 1100 via data signals, such as being downloaded electronically via a network, such as the Internet. Further, as previously described, the software for carrying out the functions associated with the present invention may alternatively be stored in internal memory/storage of the computing device 1100, such as in the ROM 1106. The computing arrangement 1100 may be coupled to a display 1114, which represents a display on which the gaming activities in accordance with the invention may be presented. The display 1114 may represent the "presentation" of the video information in accordance with the invention, and may be any type of known display or presentation screen, such as LCD displays, plasma display, cathode ray tubes (CRT), etc. Where the computing device 1100 represents a stand-alone or networked computer, the display 1120 may represent a standard computer terminal or display capable of displaying multiple windows, frames, etc. A user input interface 1128 such as a mouse or keyboard may be provided where the computing device 1100 is associated with a standard computer. An embodiment of a user input interface 1128 is illustrated in FIG. 1 as UI 110. User input interface devices may include buttons, joysticks, keyboard, mouse, microphone, touch pad, touch screen, voice-recognition system, etc.

The computing arrangement 1100 may be connected to other computing devices or gaming machines, such as via a network. The computing arrangement 1100 may be connected to a network server 1130 in an intranet or local network configuration. The computer may further be part of a larger network configuration as in a global area network (GAN) such as the Internet. In such a case, the computer accesses one or more web servers 1132 via the Internet 1134.

Other components directed to slot machine implementations include manners of gaming participant payment, and gaming machine payout. For example, a slot machine including the computing arrangement 1100 may also include a hopper controller 1136 to determine the amount of payout to be provided to the participant. The hopper controller may be integrally implemented with the processor 1102, or alternatively as a separate hopper controller 1136. A hopper 1138 may also be provided in slot machine embodiments, where the hopper serves as the mechanism holding the coins/tokens of the machine. The wager input module 1140 represents any mechanism for accepting coins, tokens, coupons, bills, credit cards, smart cards, electronic funds transfer, tickets (ticket-in-ticket-out; TITO), membership cards, etc. for which a participant inputs a wager amount.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather determined by the claims appended hereto.

What is claimed is:

1. A method for presenting gaming payouts for a gaming activity, comprising:

moving a retrieval device towards one or more perceivably selectable items among a plurality of the perceivably selectable items;

physically positioning a device supporting a plurality of actually selectable items to a position substantially aligned with the retrieval device corresponding to one or more changes of position of the retrieval device;

retrieving, by the retrieval device, at least one of the actually selectable items; and providing a payout award based on the at least one actually selectable item retrieved by the retrieval device.

2. The method of claim 1, further comprising facilitating movement of the retrieval device proximate substantially any of the perceivably selectable items prior to moving the retrieval device towards the one or more perceivably selectable items.

3. The method of claim 2, wherein facilitating movement of the retrieval device comprises allowing movement of the retrieval device under the control of a participant of the gaming activity.

4. The method of claim 2, wherein facilitating movement of the retrieval device comprises automatically moving the retrieval device under system control.

5. The method of claim 1, further comprising physically positioning the device supporting the plurality of actually selectable items to a location substantially aligned with the retrieval device after the retrieval device has reached a position where it will be moved towards the one or more perceivably selectable items.

6. The method of claim 1, wherein the device supporting the plurality of actually selectable items substantially follows positioning of the retrieval device up to a position where the retrieval device will be moved towards the one or more perceivably selectable items.

7. The method of claim 1, wherein the device supporting the plurality of actually selectable items substantially mirrors positioning of the retrieval device up to a position where the retrieval device will be moved towards the one or more perceivably selectable items.

8. The method of claim 1, further comprising concealing the device supporting the plurality of actually selectable items from a participant of the gaming activity.

9. The method of claim 1, wherein at least some of the actually selectable items are associated with a payout value, and wherein providing a payout award comprises providing a payout award based on the payout value associated with the actually selectable item retrieved by the retrieval device.

10. The method of claim 9, further comprising providing one or more secondary award indicators to supplement the payout value.

11. The method of claim 10, wherein providing one or more secondary award indicators comprises comprising at least a multiplier value, and wherein a product of the multiplier value and the payout value provides the payout award.

12. The method of claim 1, wherein moving the retrieval device towards one or more perceivably selectable items comprises moving the retrieval device under the control of a participant of the gaming activity.

13. The method of claim 1, wherein moving the retrieval device towards one or more perceivably selectable items comprises moving the retrieval device under system control.

14. The method of claim 1, wherein the gaming activity comprises a bonus gaming activity initiated in response to at least one event occurring in connection with a primary gaming activity.

15. The method of claim 1, wherein the gaming activity comprises a primary gaming activity.

16. A gaming apparatus for presenting gaming payouts in connection with a gaming activity, the gaming apparatus comprising:

a container to hold a plurality of perceivably selectable items;

a moveable retrieval device;

a moveable platform to hold a plurality of actually selectable items;

a processor configured to position the moveable retrieval device towards at least one of the plurality of perceivably selectable items, to move the moveable platform of actually selectable items corresponding to one or more changes of position of the moveable retrieval device to a position proximate where the moveable retrieval device will appear to retrieve the at least one of the plurality of perceivably selectable items, to cause the moveable retrieval device to retrieve at least one of the actually selectable items, and to provide a payout award based on the retrieved actually selectable item.

17. The gaming apparatus as in claim 16, further comprising means for moving the moveable retrieval device over the perceivably selectable items.

18. The gaming apparatus as in claim 16, further comprising means for moving the moveable retrieval device towards the at least one of the plurality of perceivably selectable items.

19. The gaming apparatus as in claim 16, wherein the moveable retrieval device comprises means for attaching at least one of the actually selectable items thereto.

20. The gaming apparatus as in claim 16, wherein the moveable retrieval device comprises a grasping claw mechanism.

21. The gaming apparatus as in claim 16, wherein the perceivably selectable items comprise perceivably selectable monetary bills.

22. The gaming apparatus as in claim 21, wherein the actually selectable items comprise actually selectable monetary bills.

* * * * *